US010168117B2

(12) United States Patent
Curliss et al.

(10) Patent No.: US 10,168,117 B2
(45) **Date of Patent: *Jan. 1, 2019**

(54) FIBER WINDING SYSTEM FOR COMPOSITE PROJECTILE BARREL STRUCTURE

(71) Applicant: Proof Research, Inc., Columbia Falls, MT (US)

(72) Inventors: David B. Curliss, Beavercreek, OH (US); Jason E Lincoln, Miamisburg, OH (US)

( * ) Notice: Subject to any disclaimer, the term of this patent is extended or adjusted under 35 U.S.C. 154(b) by 125 days.

This patent is subject to a terminal disclaimer.

(21) Appl. No.: 15/102,830

(22) PCT Filed: Dec. 9, 2014

(86) PCT No.: PCT/US2014/069403

§ 371 (c)(1),
(2) Date: Jun. 8, 2016

(87) PCT Pub. No.: WO2015/130379

PCT Pub. Date: Sep. 3, 2015

(65) Prior Publication Data

US 2016/0320156 A1 Nov. 3, 2016

Related U.S. Application Data

(60) Provisional application No. 61/913,825, filed on Dec. 9, 2013.

(51) Int. Cl.

| | |
|---|---|
| ***F41A 21/02*** | (2006.01) |
| ***F41A 21/04*** | (2006.01) |
| ***F41A 21/20*** | (2006.01) |

(52) U.S. Cl.
CPC ..... *F41A 21/02* (2013.01); *F41A 21/04* (2013.01); *F41A 21/20* (2013.01)

(58) Field of Classification Search
CPC ..... F41A 21/00; F41A 21/02; F41A 21/20; F41A 21/04

(Continued)

(56) References Cited

U.S. PATENT DOCUMENTS 2,845,741 A 8/1958 Day
2,847,786 A 8/1958 Hartley et al.

(Continued)

FOREIGN PATENT DOCUMENTS

JP 2005155935 A 6/2005
WO WO-9722843 A1 * 6/1997 ..... F41A 21/02
WO 2015031635 A1 3/2015

OTHER PUBLICATIONS

Wu, Qi-Jun, Partial English translation of "Researches on the theory and application of composite barrel," Nanjing University of Science and Technology, Aug. 2011, 14pgs.

(Continued)

*Primary Examiner* — Jonathan C Weber

(57) ABSTRACT

A composite projectile barrel is disclosed comprising a continuous fiber composite outer shell whose average effective coefficient of thermal expansion in the longitudinal direction approximately matches that of an inner liner. In one embodiment, the composite barrel comprises PAN precursor carbon fiber and a thermoset epoxy resin, with the carbon fiber wound at varying winding angles to form a plurality of regions within the outer shell. The finished barrel exhibits light weight, superior axial stiffness and strength, durability, and is reliably accurate.

29 Claims, 7 Drawing Sheets

(58) Field of Classification Search
USPC ..... 42/76.01, 76.02, 76.1; 89/15, 16, 14.7
See application file for complete search history.

(56) References Cited

U.S. PATENT DOCUMENTS

| | | | | |
|---|---|---|---|---|
| 3,517,585 | A | 6/1970 | Slade | |
| 3,879,244 | A | 4/1975 | Varlas | |
| 4,435,455 | A * | 3/1984 | Prewo | C03C 14/002 42/76.02 |
| 4,669,212 | A * | 6/1987 | Jackson | B32B 15/01 42/76.02 |
| 4,685,236 | A | 8/1987 | May | |
| 5,125,179 | A | 6/1992 | Campbell et al. | |
| 5,341,719 | A | 8/1994 | Bullis et al. | |
| 5,348,598 | A | 9/1994 | Vives et al. | |
| 5,600,912 | A | 2/1997 | Smith | |
| 5,657,568 | A | 8/1997 | Christensen | |
| 5,692,334 | A | 12/1997 | Christensen | |
| 5,804,756 | A | 9/1998 | Christensen | |
| 6,189,431 | B1 | 2/2001 | Danner et al. | |
| 6,889,464 | B2 | 5/2005 | Degerness | |
| 9,863,732 | B2 * | 1/2018 | Curliss | F41F 1/06 |
| 2004/0244257 | A1 | 12/2004 | Degerness | |
| 2005/0175805 | A1 | 8/2005 | Hild et al. | |
| 2005/0268517 | A1 | 12/2005 | Withers et al. | |
| 2006/0260597 | A1 * | 11/2006 | Anderson | F41A 21/02 124/83 |
| 2007/0261599 | A1 | 11/2007 | Schwab et al. | |
| 2009/0068441 | A1 | 3/2009 | Swaroop et al. | |
| 2010/0310823 | A1 | 12/2010 | Albertelli et al. | |

OTHER PUBLICATIONS

Wu, Qi-Jun, Researches on the theory and application of composite barrel, Nanjing University of Science and Technology, Aug. 2011, China Academic Journal Electronic Publishing House, http://www.cnki.net, 125 pgs.

Machine Translation of JP 2005-155935 to Ishizuka, European Patent Office, Jun. 2005.

* cited by examiner

FIBER WINDING SYSTEM FOR COMPOSITE PROJECTILE BARREL STRUCTURE

CROSS REFERENCE TO RELATED APPLICATIONS

This application claims priority to Provisional Patent Application: No. 61/913,825 filed Dec. 9, 2013. The entire disclosure of that provisional application is hereby incorporated by reference and relied upon.

BACKGROUND OF THE INVENTION

Users have long desired lighter weight gun systems that remain durable and reliably accurate. It is known to substitute relatively strong but lightweight materials—such as unreinforced and reinforced polymers, continuous glass fiber or carbon fiber composites—for various portions of the gun commonly fabricated from steel, aluminum, or other metals. Attention has focused on gun barrels, which constitute a large percentage of a gun's weight. It is known, for example, to fabricate a gun barrel having an inner liner, typically a steel alloy, surrounded by a continuous carbon fiber reinforced polymer matrix composite outer shell. With the appropriate choice of materials and properly engineered, this combination lightens the gun while retaining good barrel strength and stiffness.

The carbon fibers used in the outer shell may be any types that provide the desired stiffness, strength and thermal conductivity. Typically for gun barrel applications, polyacrylonitrile ("PAN") precursor or pitch precursor carbon fibers are used. The carbon fiber may be applied in a wet filament winding operation, wherein dry carbon fiber strands or tows are combined with a resin in a "wet" dip pan process, then wound around the inner liner and processed. Alternatively, the shell may be fabricated from carbon fiber tow, unidirectional tape, or fabric that was previously impregnated with resin in a separate process ("towpreg" or "prepreg"), or a textile preform wherein the resin is infused into the braided preform, then applied to the inner liner in a process that cures the prepreg into a hard thermally stable matrix and simultaneously bonds the outer shell to the barrel inner liner. Whether applied by wet filament winding, resin infusion into a dry preform, or by application of prepreg materials, the matrix resin is typically a crosslinkable epoxy, but the resin may be a polymer such as a polyimide, bismaleimide, cyanate ester, inorganic polymer, thermoplastic polymer, or some other material as the inventors described in patent application PCT/US14/53194 (Curliss), the specification and drawings of which are hereby incorporated in their entirety. The matrix binder may not be an organic polymer resin at all, but may be an inorganic polymer, a metal, a ceramic, allotropes of carbon, or a mineral. The composite barrel may then be cured (where relevant), finished, and attached to a receiver and stock. Such carbon fiber reinforced composites can provide a suitable balance of thermal properties, mechanical properties, and processing characteristics for many common firearms applications. Other fibers known to those skilled in the art, including continuous glass fibers, continuous ceramic fibers, continuous metallic fibers, continuous graphite fibers, continuous mineral fibers, continuous polymer fibers and/or combinations thereof may also be used as the reinforcement phase.

Such composite gun barrels, however, can pose problems not encountered with traditional steel barrels. First, the composite must be constructed in a manner and quantity around and along the liner to ensure that the barrel does not burst upon firing, to achieve satisfactory strength and stiffness in the principal directions (e.g., axially and torsionally), to provide adequate environmental durability, and to dampen the shock wave that propagates when the projectile is fired. For example, dampening of the shock wave through reflection, refraction, and interaction in inhomogeneous materials will vary depending on material properties, such as fiber diameter and geometric orientation, and volume fraction of the continuous fibers within the matrix.

Most of the foregoing issues can be addressed by additional windings, e.g., more circumferential "hoop wraps" to improve burst strength and more axially oriented helical windings to improve axial tensile and flexural strength and stiffness. Torsional stiffness is a significant design factor important in medium and large caliber barrels having rifling. However, adding more layers of windings can lead to manufacturing and curing complications, higher material expense, more weight, and a bulkier barrel profile than desired. Fiber selection can also address these problems to some extent. Generally lower density, stronger and stiffer fibers are preferred provided they do not exhibit other undesirable characteristics, such as poor resin adhesion.

Second, thermal management is a significant concern, inasmuch as the more common continuous fiber composite ("CFC") outer shells are relatively poor conductors of the heat generated by hot gasses within the liner. Additional layers of CFC windings exacerbate the heat removal problem. During operation, the barrel will heat up. In the case where the matrix phase is an organic polymer, if the cured resin within the CFC reaches its glass transition temperature, $T_g$, the CFC softens significantly and the mechanical integrity of the composite barrel is compromised. As the barrel is heated to even higher temperatures, irreversible thermal decomposition of the cured matrix occurs and barrel structural integrity is further compromised. U.S. Pat. No. 6,889,464 (Degerness) added a thermally conductive material to the resin mixture to improve thermal conductivity and heat dissipation. Curliss, supra, (PCT/US14/53194) disclosed a novel method for manufacturing gun barrels using resins that withstand higher temperatures, and disclosed using small particles of metal such as aluminum as a thermal conducting additive.

A third problem relates to stresses within the barrel arising from thermal expansion differences between the composite and the inner liner of the composite barrel. As the inner steel liner heats during operation, it expands both radially and longitudinally. Composite structures in the prior art have a substantially lower average effective coefficient of thermal expansion (CTE) in the longitudinal direction than steel and so when heated, the CFC outer shell expands substantially less than the steel liner. This may increase or decrease thermal stresses in the barrel depending on the state of thermal residual stress from processing. The point is that as the temperature changes in the barrel, due to operation or the environment, the state of residual stress in the barrel also changes. For example, the CTE of type 416 grade stainless steel, an alloy commonly employed in steel gun barrels, is about 5.55 parts per million per degree Fahrenheit (5.55 ppm/° F., or $5.55\times10^{-6}$/° F.), while the longitudinal average effective CTE for a typical CFC outer shell employing PAN precursor carbon fiber and a thermoset epoxy resin is less than about 3 ppm/° F. When a type 416 stainless steel liner and a typical CFC are subjected to heating during operation, uneven expansion can produce thermal stresses on the liner-CFC interface, possibly even causing separation of the CFC from portions of the liner or fractures within the CFC shell. Even if no separation occurs, minor variations in the CFC or metal liner properties, or geometric variation, may promote uneven thermal stresses at the interface between the barrel and CFC that may result in nonlinear deformation or displacement of the barrel from its original axis. Even a very slight displacement can significantly degrade accuracy. Moreover, even if the barrel and liner remain perfectly true, the various layers of windings within the CFC can have different CTEs, especially longitudinally. When subjected to elevated operating temperatures, differences in the thermal expansion of adjacent winding layers within the CFC can result in high levels of interlaminar shear stress and even delamination.

U.S. Pat. No. 5,692,334 (Christensen) disclosed eliminating any bond or adhesion between the inner liner and the CFC. Unfortunately, this approach virtually eliminates any contribution of the outer shell to axial stiffness, torsional stiffness, or circumferential reinforcement. The same inventor in U.S. Pat. No. 5,804,756 recognized that steel and the composite shell have different CTEs, but attempted to match thermal expansion only in the radial direction. Indeed, one object of the '756 patent is to "have nearly 0 coefficient of thermal expansion in the axial direction." The '756 patent expressly teaches that reducing the CFC's expansion to zero in the axial direction improves accuracy. '756 patent col. 2, line 23; col. 6 line 11.

U.S. Pat. No. 5,600,912 (Smith) teaches mechanical compression of the carbon fiber composite outer shell longitudinally after it is cured to improve barrel stiffness, which compression could also help compensate for a lower CFC thermal expansion when the barrel is heated during operation. However, mechanically compressing the CFC risks damage e.g., through over tightening, and in any case the "proper" amount of cold residual compression to apply will vary depending on the barrel's operating temperature as well as structural characteristics such as barrel length and liner profile. Like Smith, U.S. Pat. No. 6,189,431 (Danner) also mechanically exerts residual cold compression on the CFC, but it is accomplished by means of steel flanges on the liner ends which compress the CFC as the steel liner contracts more than the CFC during the cooling phase of the curing process. Like Smith, Danner does not address the underlying problem of mismatched CTEs, and seems to accept as a given that a steel liner inherently has a higher CTE than a continuous fiber composite. Moreover, Danner continues the prior art of abruptly alternating winding angles between layers.

Producing an optimized composite barrel must balance competing considerations. What is needed is a carbon fiber composite projectile barrel that employs reasonably priced materials, that provides superior axial and torsional strength and stiffness while minimizing weight and radial bulk, that minimizes interlaminar stress, and that does not deform when heated due to mismatched axial CTEs between the liner and outer shell.

BRIEF SUMMARY OF THE INVENTION

A composite projectile barrel is disclosed comprising a novel continuous fiber composite outer shell that offers superior axial and torsional strength and stiffness, minimizes weight and radial bulk, and does not distort when heated due to mismatched axial CTEs between the inner liner and CFC outer shell. In one embodiment, the invention comprises a barrel for directing the path of a dischargeable projectile including an inner liner defining an axial bore and having a coefficient of thermal expansion, and a CFC outer shell surrounding and in direct contact with the inner liner, wherein the average effective axial CTE of the CFC is approximately equal to the axial CTE of the inner liner.

It is to be understood that the invention may be practiced with projectile barrels of virtually any length, contour or caliber with comparable effectiveness, and on other structures where fiber is combined with a resin and wound or otherwise constructed around along an elongated axis. For example, the invention is equally suitable to short handgun pistol barrels, small caliber sporting guns and military weapons, as well as medium and large caliber military weapons barrels such as barrels for the 25 mm M242 Bushmaster, or the M256A1 120 mm smooth bore main gun of the Abrams M1A2 tank.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Figure 1:
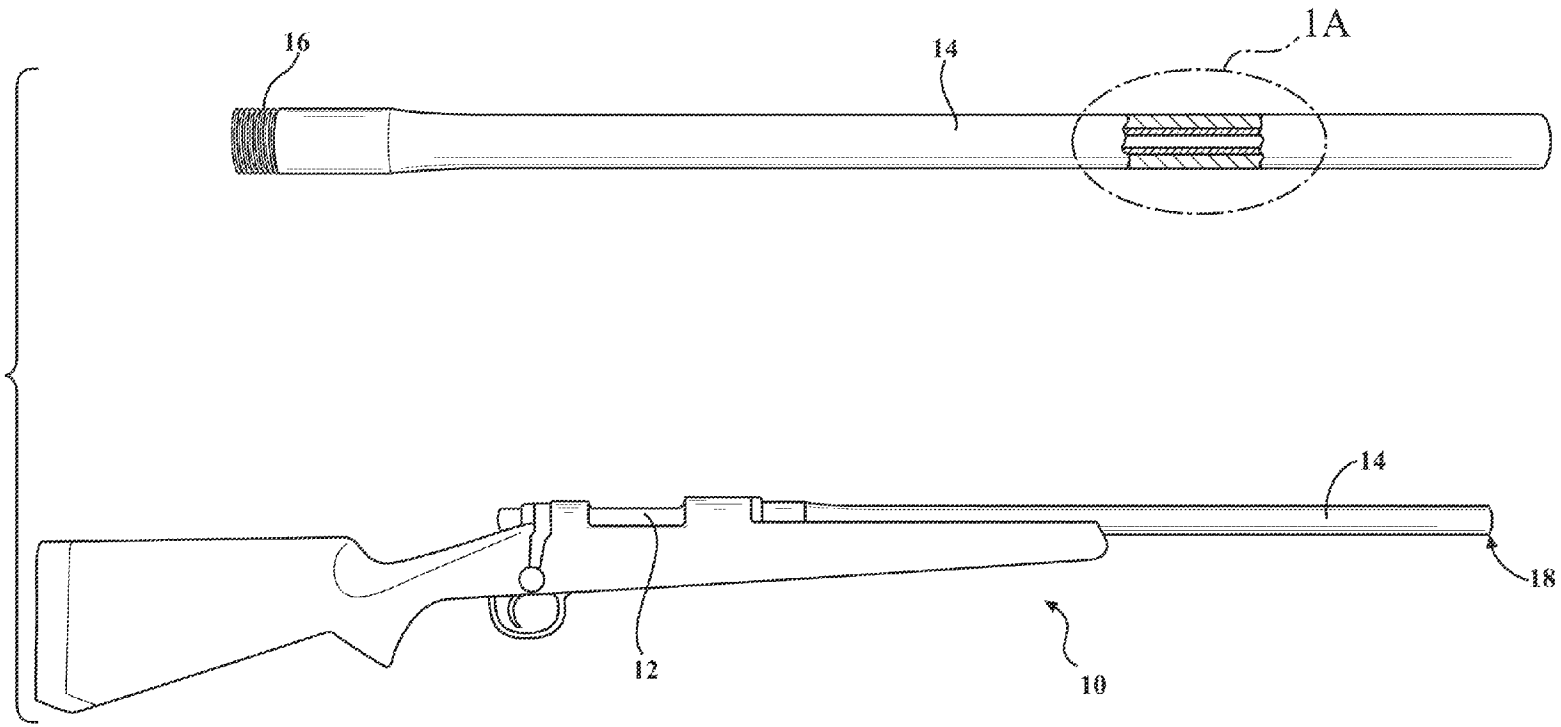
FIG. 1 illustrates a rifle fitted with a composite barrel.

Referring to the figures, wherein like numerals indicate like or corresponding parts throughout the several views, FIG. 1 shows a bolt action rifle 10 fitted with a receiver 12, stock, trigger, barrel 14, and other familiar features. In the embodiment shown, barrel 14 securely engages with receiver 12 by means of threads 16. In operation, a cartridge of ammunition is inserted into the receiver. The cartridge has a base portion containing a gunpowder charge and dischargeable projectile, i.e., a bullet. When a shooter pulls the trigger, a firing pin strikes the base of the cartridge, igniting the gunpowder charge and causing the bullet to discharge through axial bore 24 and out of the muzzle 18.

Figure 1A:
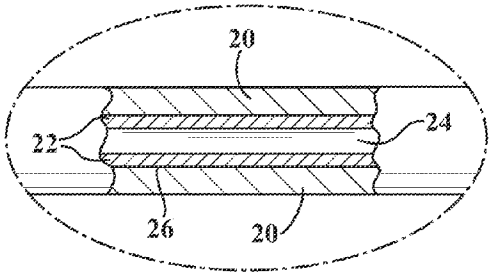
FIG. 1A is a cut-away of a portion of the composite barrel shown in FIG. 1.

As shown in FIG. 1A, barrel 14 is comprised of an inner liner 22 and an outer shell 20. The liner may be fabricated from any metal or refractory material commonly used and known to be useful for firearms barrels or a combination of the foregoing. A steel alloy inner liner 22, such as AISI type 416 stainless steel, has good machining properties, facilitating precisely boring and rifling lands and grooves along axial bore 24 as well as threads at the muzzle and/or breech ends of the barrel. Other steel alloys, including other alloys in AISI classes 400 and 4000, have demonstrated good performance as gun barrel inner liners. Outer shell 20 is a continuous fiber composite (CFC). For purposes of the specification and claims, "CFC" means a composite comprised of continuous fibers such as continuous PAN and pitch carbon fibers, continuous glass fibers, continuous ceramic fibers, continuous metallic fibers, continuous graphite fibers, continuous mineral fibers, continuous polymer fibers, and combinations thereof; and a matrix binder material such as an organic polymer, an inorganic polymer, a metal, a ceramic, allotropes of carbon, or a mineral. Inner liner 22 need not be uniformly cylindrical. For example, inner liner 22 may radially expand at the breech end to accommodate cutting of threads 16 for insertion into receiver 12, taper outwards at the muzzle 18, or include other configurations such as a gas block journal depending on desired features of the gun. Outer shell 20 likewise may include non-cylindrical features or be discontinuous over the length of barrel 14.

Outer shell 20 is in direct contact with inner liner 22 at interface 26. It may be desirable to promote adhesion or to inhibit corrosion between the inner liner 22 and CFC outer shell 20 at interface 26. For purposes of this specification and the claims, "direct contact" means that the outer surface of inner liner 22 at interface 26 may include a surface treatment that is applied before outer shell 20 is fabricated upon inner liner 22. For example, a CFC outer shell 20 is in "direct contact" with a steel inner liner 22 at interface 26 even if the steel liner's surface is electroplated, anodized, or coated with a chemical compound or mixture, such as paint, resin, hot glass, or other substance.

Figure 2:
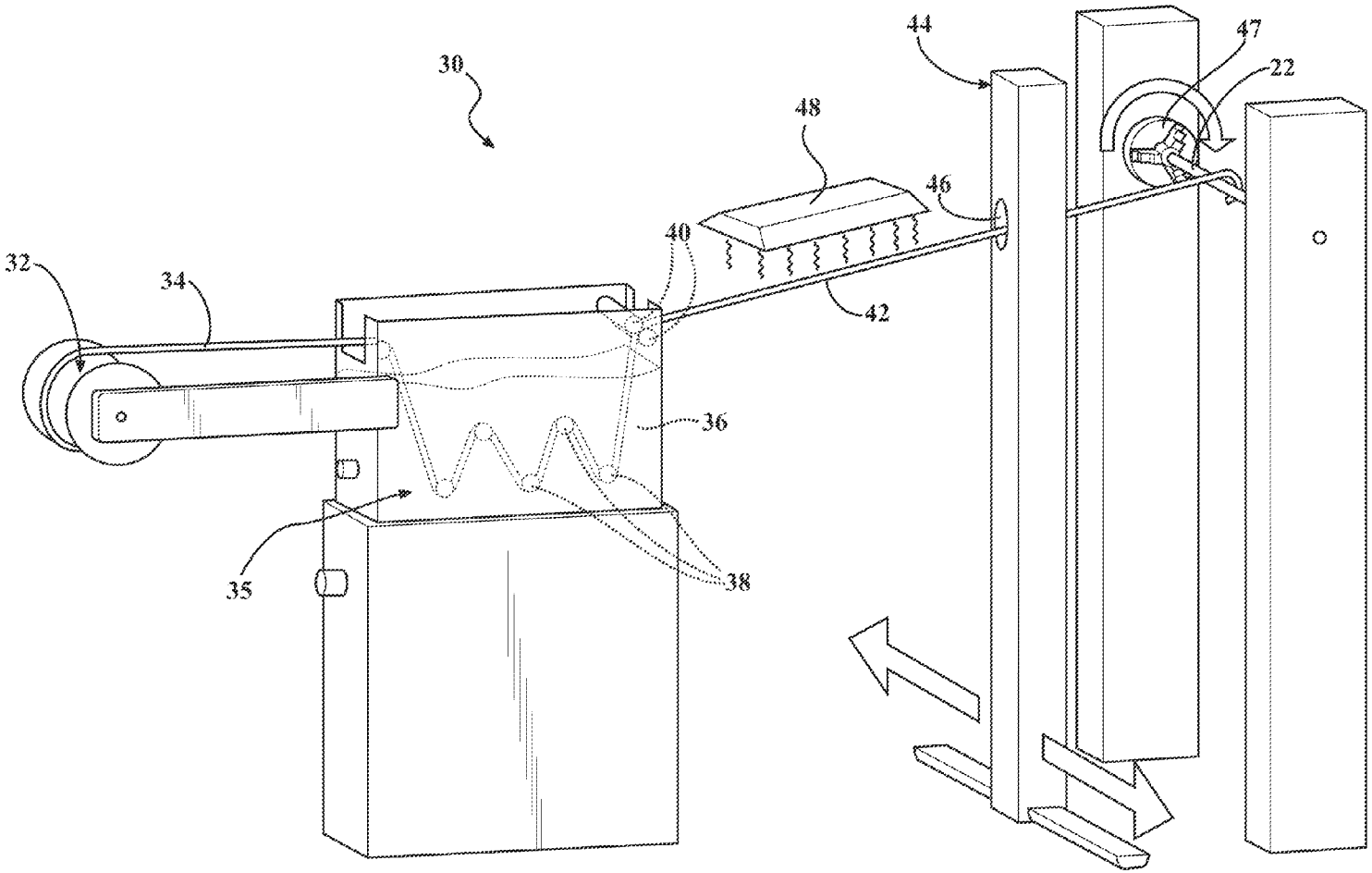
FIG. 2 illustrates a resin tow winding system.
Figure 3:
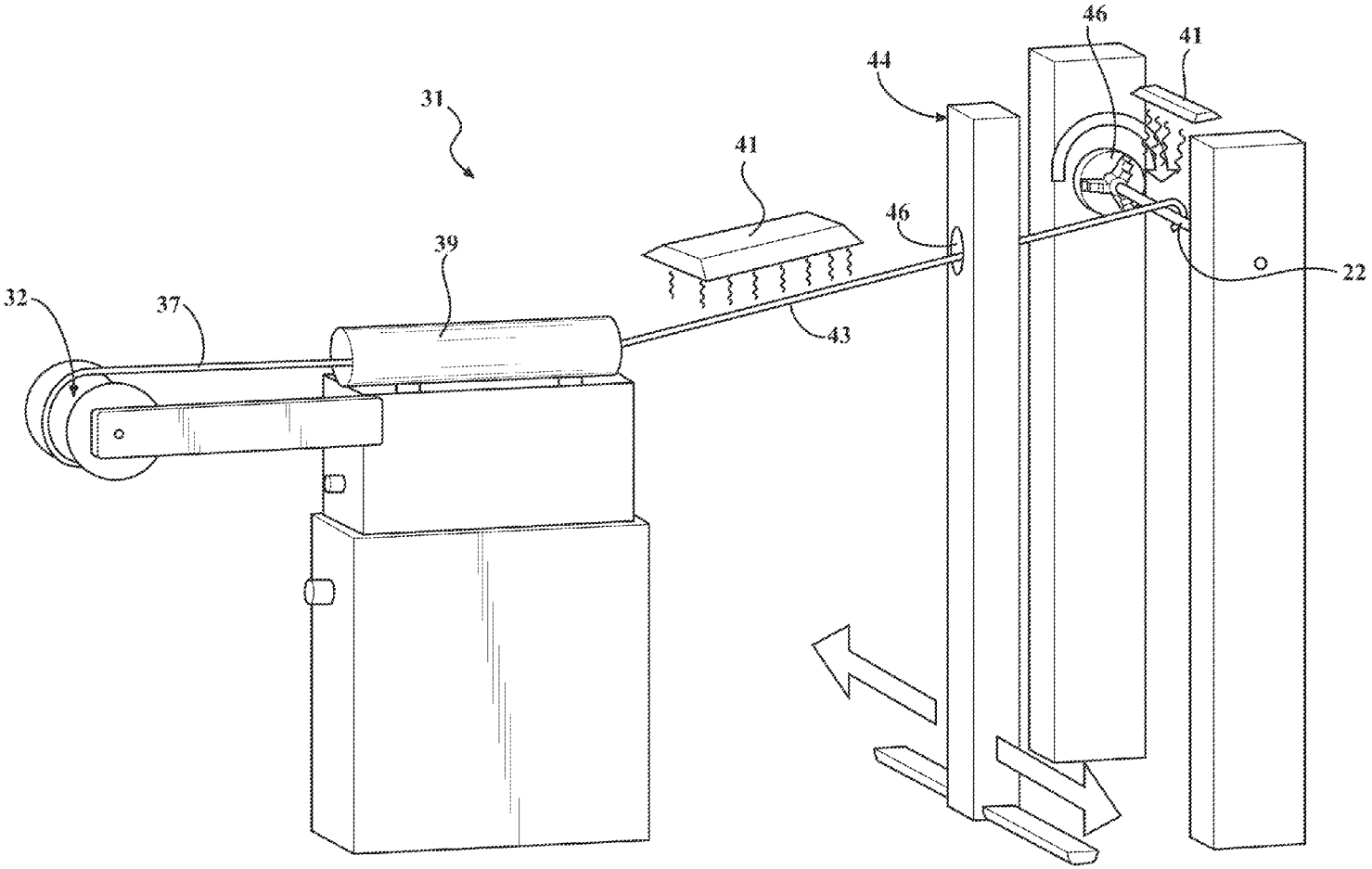
FIG. 3 illustrates a dry towpreg winding system.

FIG. 2 shows a simplified tow winding system 30 useful for fabricating a composite gun barrel 14 having a CFC outer shell 20. In one embodiment, outer shell 20 comprises continuous fiber filament, or tow, 34, supplied from tow spool 32. In another embodiment (not shown) the fiber could be in the form of fabric or a weave. Carbon fibers are typically advantageous to use for CFC gun barrels due to their high stiffness, high strength, and low density. The term "carbon fiber" is used to generically describe carbon and graphite fibers irrespective of their manufacturing process or precursor materials, and specifically includes both PAN precursor and pitch precursor carbon fibers. The term "continuous" fiber, as known to those in the art, differentiates such essentially endless fiber from discontinuous fibers, e.g. chopped or ground carbon fibers. In one embodiment, tow 34 is an intermediate modulus PAN carbon fiber filament tow, such as HexTow IM2A available from Hexcel Corporation, Stamford Conn. IM2A has a modulus of 40 Msi (276 GPa). For purposes of this specification and claims, "intermediate modulus" means a modulus of elasticity between approximately 38 and 46 Msi (about 265-320 GPa). However, tow 34 could also be a pitch carbon fiber, such as GRANOC CN-60-A2S, available from Nippon Graphite Fiber Corporation, Tokyo, Japan, or any suitable fiber for manufacturing composites including Kevlar, glass, quartz, ceramic, mineral, carbon, metallic, graphite, or hybridizations of fibers formed by combining different types of fibers to gain characteristics not attainable with a single reinforcing fiber.

Tow 34 is drawn from tow spool 32 under tension by rotating inner liner 22 which functions as a mandrel. Inner liner 22 is placed between chucks 47 and rotates about axial bore 24. The rotating inner liner 22 tugs tow 34 through a resin mixture 36, dipping around a series of rollers 38 immersed in resin bath 35, with the rollers 38 helping to press resin mixture 36 into tow 34. Those skilled in the art will appreciate that there are multiple ways of applying resin to the tow. In another embodiment (not shown), tow 34 could be drawn across the upper surface of a semi-immersed rotating drum wetted with resin.

Brisk movement of tow 34 through resin mixture 36 and around rollers 38 creates currents and turbulence helping to maintain resin solids and other particulates in suspension within resin mixture 36. Optionally, an agitator (not shown) placed in resin bath 35 may be utilized to facilitate uniform mix and viscosity of the resin, solvent, and any added particulates or other thermally conductive materials added as solids to the resin mixture 36. The agitator may be a mechanical paddle driven by a motor, a resin mixture recirculation system driven by a pump, an ultrasonic agitator, or other means for maintaining solids and particulates in suspension.

After the filament is impregnated with the resin mixture 36, excess resin mixture is removed from the tow. Excess resin mixture may be removed from the tow by means of nip rollers 40 having an appropriate gap setting, scrapers (not shown), appropriately-sized dies (not shown) and/or other means known in the art, individually or in combination.

Resin infused tow 42 exits resin bath 35 and is drawn through a filament guide orifice 46 controlled by filament guide structure 44. Optionally, one or more heating elements 48 may flash off first stage volatiles present in resin mixture 36 after the resin infused tow 42 exits resin bath 35 by means of a heat unit 48. The heating units cause volatilization of some or even most of any solvent that is present on resin infused tow 42. The heating elements 48 may be placed anywhere on the path of resin infused tow 42, including heating the mandrel inner liner 22 itself. The heating elements may be radiant heaters, tube furnace/heaters, convection heaters, or other means of heating resin infused tow 42, including various types of heating elements in combination.

After the excess resin mixture 36 is mechanically removed and optionally subjected to heating, resin infused tow 42 is wound around the inner barrel in the desired helical pattern and to a desired diameter. Filament guide structure 44 includes a mechanism for laterally translating filament guide orifice 46 generally parallel to axial bore 24, thereby guiding resin infused tow 42 back and forth along rotating inner liner 22, so that resin infused tow 42 is applied to inner liner in a helical winding pattern. Filament guide orifice 46 itself may also rotate or translate relative to filament guide structure 44.

It will be appreciated that if inner liner 22 rotates at a constant rate, faster lateral movement of filament guiding structure 44 will result in a helical winding pattern of resin infused tow 42 characterized by smaller winding angles relative to axial bore 24. At a brisk lateral speed, the helical winding angle of resin infused tow will be small, nearly longitudinal relative to axial bore 24. Conversely, slower lateral movement of filament guiding structure 44 will result in larger helical winding angles relative to axial bore 24. At very slow lateral speeds, winding angles of resin infused tow 42 may be nearly circumferential hoops, almost 90 degrees. For purposes of the claims and this specification, such nearly circumferential hoops are nevertheless "helical." Tow winding system 30 may be controlled by a computer processor, so that rotation speed of the inner liner 22, lateral movement of the filament guide structure 44, movements of filament guide orifice 46, tension applied to tow 34, and other aspects may be programmed by a user to produce desired patterns and sequences of winding angles, number of layers, and depths of the layers. Such systems are available from, for example, McLean Anderson, 300 Ross Avenue, Schofield, Wis. 54476.

Resin mixture 36 may comprise a variety of thermoset or thermoplastic resins, including but not limited to epoxy, bismaleimide, phenolic, and polyimide resins. In one embodiment, resin mixture 36 comprises a thermoset epoxy resin. In another embodiment, resin mixture 36 comprises a polymerizable monomer reactant (PMR) type thermoset polyimide resin. Resin mixture 36 may be heated or solvated to reduce viscosity and ensure satisfactory impregnation of tow 34. Resin bath 35 may be configured to heat resin mixture 36 using techniques known to those skilled in the art, such as circulating a hot fluid, such as water, through a jacket surrounding resin bath 35, or applying heating elements to the bottom or sides of resin bath 35, or via a heating coil immersed in resin mixture 36. Many solvents may be utilized to make the resin less viscous, including alcohols such as methanol or ethanol, aprotic solvents, and mixtures thereof. The PMR type thermoset polyimide resin will typically include an alcohol co-reactant that acts as a solvent. A solvent having a lower boiling point (i.e., higher volatility) is generally more desirable because it can be more easily flashed off the resin infused tow 42 with heating units such as a heat unit 48.

Returning to the composition of carbon fiber, tow 34 is comprised of carbon fiber strands that are preferably collected into a flat tow. In one embodiment, the individual carbon fiber strands are PAN precursor carbon fibers each having a diameter of approximately 7 μm (microns), and each tow 34 comprises about 12,000 individual carbon fiber strands. In one embodiment, tow 34 is Hextow IM2A carbon fiber filament available from Hexcel Corporation. IM2A is an aerospace grade PAN carbon fiber having an intermediate modulus of elasticity. This PAN carbon fiber exhibits good strength and stiffness, good heat conductivity, yet its cost is affordable for commercial manufacturing purposes.

It should be understood that the completed outer shell 20 could comprise more than one type of carbon fiber. One might simultaneously wind a plurality of tows having different characteristics, e.g., two carbon fiber tow strands having complementary characteristics such as PAN and pitch, or that the type of fiber in tow 34 could be changed as the outer shell 20 is being wound, such as using PAN fiber for hoops then switching to pitch fiber tows for some or all of the longitudinal-oriented windings, without altering the intended meaning of the claimed invention. Similarly, even though the manufacturing method recited in the claims recites "the fiber tow," it is intended that one might use a plurality of tows within the outer shell 20 without departing from the scope of the claimed invention, for example utilizing a different fiber type depending on region, or combining a plurality of tows.

To increase the burst strength of the barrel, it is known to be advantageous to wind tows 34 circumferentially about inner liner 22 in helical hoops, e.g. ±85° (plus or minus about 5° relative to the longitudinal axis of the barrel). For axial strength and stiffness, to minimize barrel 14 from flexing due to shockwaves arising from discharge of a bullet for example, it is preferable to have more longitudinal helical wraps, e.g. ±25° (again plus or minus about 5° measured relative to the longitudinal axis of barrel 14). To promote maximum axial stiffness with the fewest tows, it is preferable to locate the longitudinal helical wraps at or near the outer region of outer shell 20. The surface of outer shell 20 can be made more durable to wear and tear, however, if the outer region of outer shell 20 is wrapped at a less acute angle, e.g. 45°.

Figure 4:
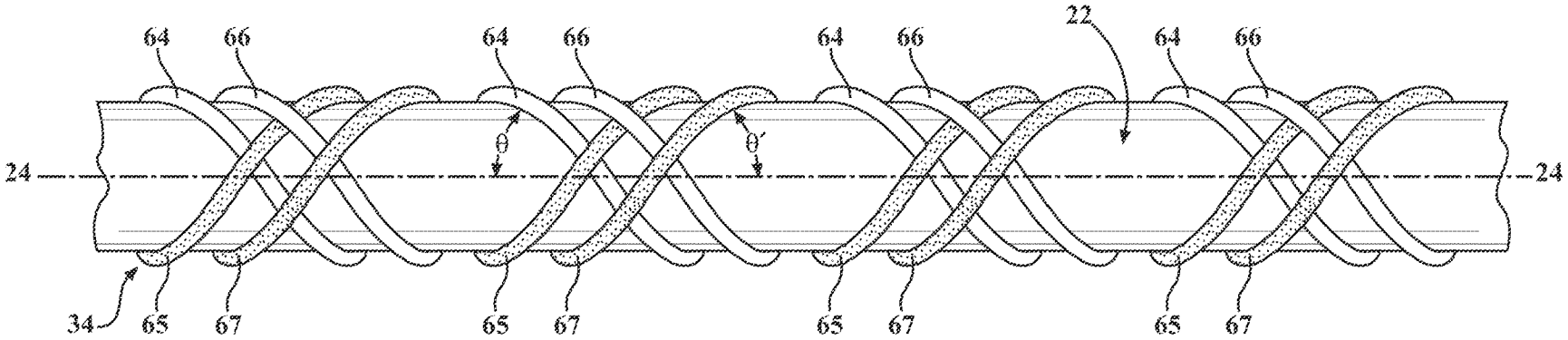
FIG. 4 is a side view showing a section of the inner liner being wrapped at a substantially constant wrapping angle.

Unless the context dictates otherwise, reference in the specification and claims to "winding angle" or "wrap angle" includes the positive and negative measured fiber angles relative to the barrel's longitudinal axis. This is illustrated in FIG. 4, which shows a section of inner liner 22 in the initial stage of being wrapped with tow 34. (In practice, tow 34 typically has a wide, flat profile. Its profile is "fattened" in FIG. 4 to better illustrate tow placement.) Tow 34 is helically wrapped around inner liner 22 as filament guide 44 translates laterally relative to rotating inner liner 22. The first lateral pass (left to right) winds a first tow segment 64. When filament guide 44 completes its translation and reaches the end of inner liner 22, it reverses and helically winds the tow in the opposite direction, laying down second tow segment 65. The next pass winds third tow segment 66, and the next pass winds fourth tow segment 67. The winding angle for all four segments in FIG. 4 is the same, albeit the angles alternate between positive and negative with each pass, measured relative to axial bore 24. For purposes of the claims and specification, angle θ shown in FIG. 4 with respect to first tow segment 64 is the "same wrapping angle" as θ' shown in FIG. 4 with respect to fourth tow segment 67. In other words, the wrapping angle shown in FIG. 4 is constant. Reference in the specification and the claims to "helical" means substantially helical, e.g., portions of inner liner 22 may not be strictly cylindrical.

Figure 5:
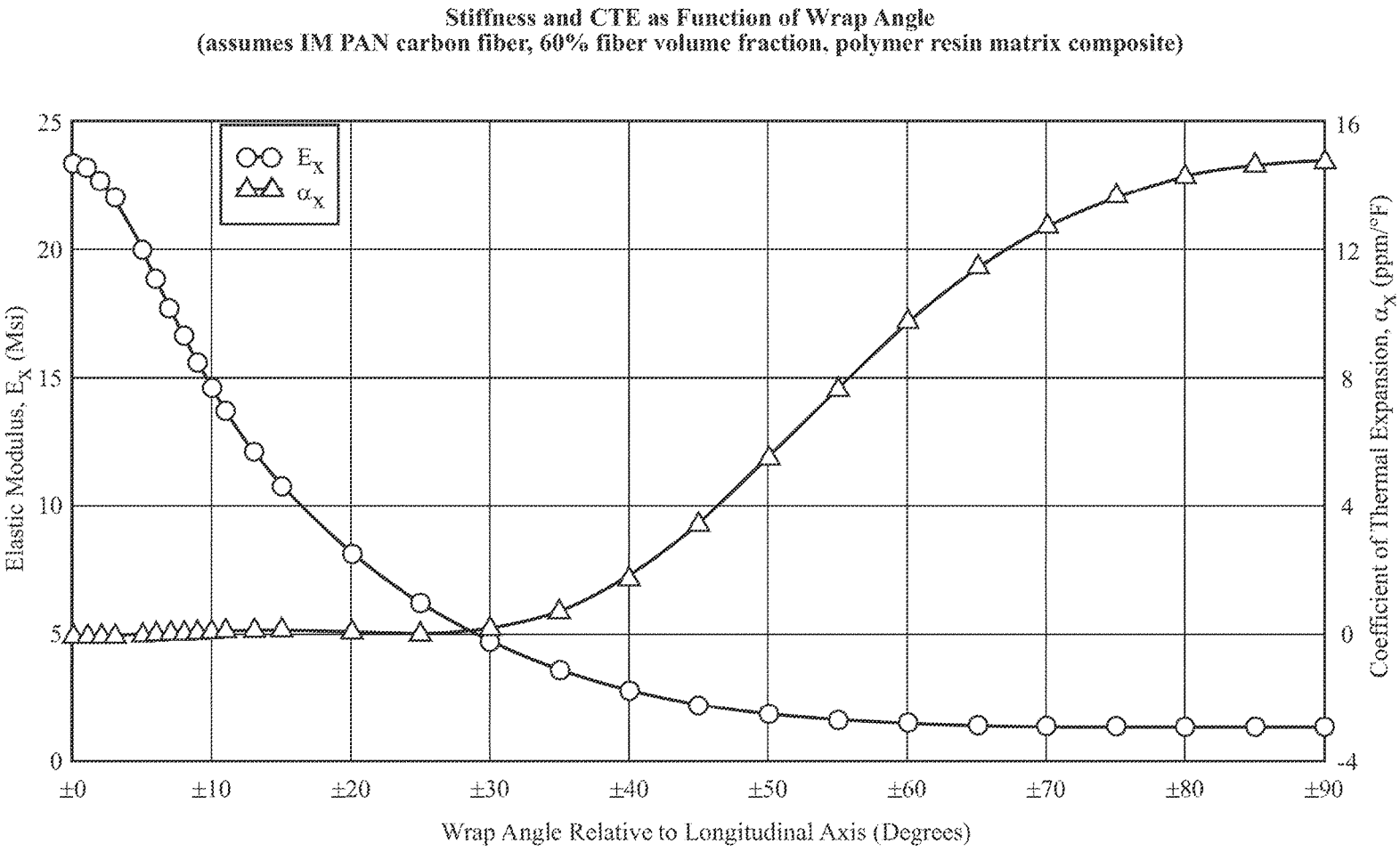
FIG. 5 is a chart showing the relationship between CFC wrap angle, angle effect on axial stiffness, and angle effect on axial CTE.

As noted, axial stiffness varies with the wrap angle of tow 34. FIG. 5 shows stiffness numbers calculated under classical laminate theory assuming an intermediate modulus PAN carbon fiber at 60% fiber volume fraction in a polymer resin matrix composite. The first data on the chart shows the effect of wrap angle on the stiffness of the outer shell in the axial direction, measured as millions of pounds per square inch (Msi). At zero degrees relative to the barrel's axis (i.e., parallel to axial bore 24) the elastic modulus $E_x$ is nearly 24 Msi, which approaches type AISI 416 stainless steel (UNS S41600) which has $E_x$ of 29 Msi. As the winding angle relative to the barrel's axis increases, stiffness drops sharply. At a winding angle of ±45°, $E_x$ falls to about 2.4 Msi. For near-perpendicular "hoop" windings, their contribution to axial stiffness is small, falling to under 2 Msi.

FIG. 5 also shows the effect of winding angle on linear CTE through the CFC. Lower winding angles (i.e., more axially aligned) have much lower CTE α. Near-perpendicular wrap angles (hoops) have relatively high longitudinal CTE, about 15 ppm/° F. The CTE of inner liner 22 may vary considerably depending on composition. For example, a ceramic or ceramic composite inner liner may have a CTE that is considerably less than steel. AISI 4140 steel has a CTE of approximately 6.8 ppm/° F. As mentioned previously, AISI 416 stainless steel has a CTE of approximately 5.55 ppm/° F. Referring to FIG. 5, if the entire outer shell 20 could be wrapped at a constant angle of about 48°, the average effective longitudinal CTEs of outer shell 20 and a type 416 stainless steel inner liner 22 would approximately match, theoretically solving many of the problems arising from mismatched CTEs. However, it is not practical to wrap the entire outer shell 20 at that angle, at least partly because a uniform 48° wrap would not provide sufficient axial stiffness or burst strength without excessive windings.

The average effective longitudinal CTE of the CFC outer shell 20 will vary depending not only on wrap angle, but on a variety of other factors including matrix composition (e.g., whether resin versus ceramic or metal, type of resin, etc.), presence of matrix additives such as thermally conductive heat dissipation additives, fiber type, tow tension during wrapping, regional wrap angle sequence, and regional wrap angle thicknesses. All of these factors must be considered when attempting to match the average effective longitudinal CTE of the CFC outer shell to the CTE of the steel liner. It is possible to design and fabricate a CFC outer shell having a desired average effective longitudinal CTE fabricated from materials other than unidirectional carbon fiber continuous tows, including for example textile composite prepreg carbon fiber, and carbon fiber braided sleeves. Noncarbon materials may also be used, such as ceramic, glass, mineral, polymer or metallic fibers, or mixtures thereof.

More specifically, the inventors have discovered that it is possible to match the average effective axial CTE of a CFC outer shell 20 to the CTE an inner liner 22 by using a plurality of wrapping regions, while also providing excellent axial, radial, and torsional strength and stiffness, yet keeping bulk and weight at a minimum. Using known CTE data and wrapping techniques familiar to those skilled in the art of fiber laminates, e.g. the relationships illustrated in FIG. 5, it is possible to engineer a laminate CFC outer shell 20 having good structural properties and a desired average effective CTE by wrapping a plurality of regions, each region having substantially the same winding angle and each having a radial thickness relative to the radial thickness of the CFC.

Figure 6:
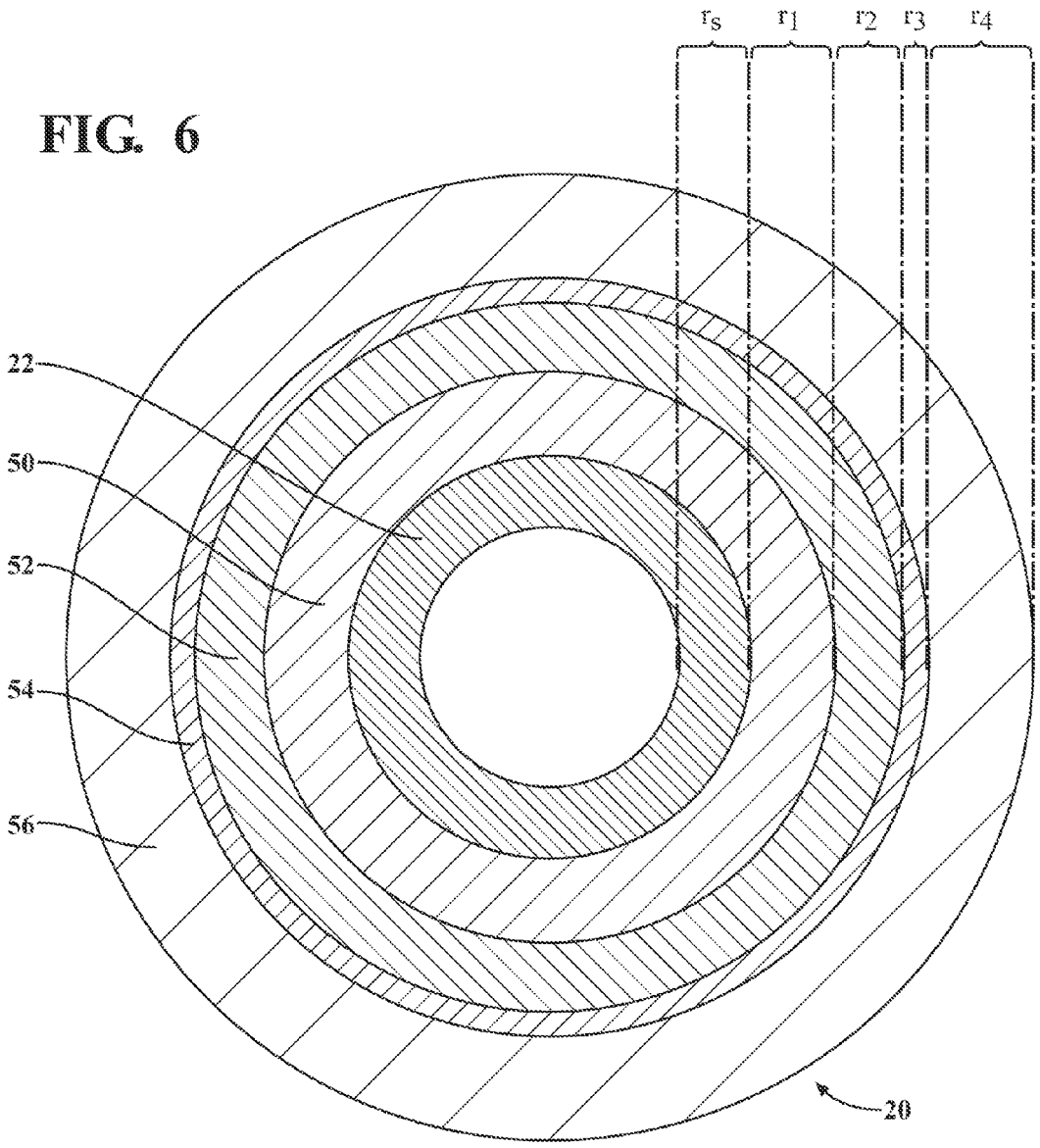
FIG. 6 is an end view of an exemplar composite barrel showing radial thickness of composite regions.

Referring to FIGS. 1A and 6, CFC outer shell 20 surrounds and is in direct contact with inner liner 22. For purposes of the claims and this specification, "surrounding the inner liner" means that outer shell 20 surrounds and is in direct contact with inner liner 22 along at least a portion of the axial length of barrel 14; parts of inner liner 22 may be exposed, for example, at muzzle 18, threads 16, a gas block (not shown), or any other desired location(s) on barrel 14. Outer shell 20 is structured in successive regions, with each region having substantially the same winding angle. The radial thickness of each region as a percentage of the CFC radius varies. In the exemplar embodiment shown in FIG. 6, inner liner 22 has a radial depth $r_s$, inner region 50 has a radial depth $r_1$, first intermediate region 52 has a radial depth $r_2$, second intermediate region 54 has radial depth $r_3$, and outer region 56 has radial depth $r_4$. The sum of radial thicknesses of the regions in CFC outer shell 20 ($r_1+r_2+r_3+r_4$) equal the radial thickness of CFC outer shell 20. Thus the thickness of each region can be expressed as a percentage of the radial thickness of outer shell 20.

Known classical laminate theory may be used to engineer a CFC outer shell 20 having a wide range of average effective longitudinal CTEs using a plurality of layered wrapping regions. The average effective CTE of the composite outer shell 20 is adjusted by varying the wrap angles of the plurality of regions, the regions' radial thicknesses, and the number and sequence of regions. The CTE may also be varied by changing the composition of resin/binder, the type of fiber, and the tension at which fiber tow 34 is wrapped on liner 22. For example, one embodiment that approximately matches the CTE of type 416 stainless steel inner liner 22 with the CTE of CFC outer shell 20 comprises intermediate modulus PAN precursor carbon fibers and thermoset epoxy resin. This embodiment not only virtually eliminates thermal stresses due to CTE mismatch that can lead to deformation and displacement, but also provides superior performance, durability, with relatively low bulk and weight, at a commercially viable price for materials. "Approximately matches" for purposes of this specification and the claims means that the inner liner's longitudinal CTE is within 1 ppm/° F. of the average effective longitudinal CTE associated with the CFC outer shell.

In addition to matching the average effective longitudinal CTE of outer shell 20 with inner liner 22, a superior barrel design also exhibits high axial strength and stiffness, low interlaminar shear stress during operation, and high hoop strength. Low angle plies (e.g., ±25°) provide more axial stiffness than higher angles. Moreover, the further away a given mass of longitudinal plies is located from the steel liner, the greater its contribution to axial stiffness. However, placing longitudinal low-angle plies on the outside of barrel 14 compromises durability, because they are more likely to delaminate or suffer interlaminar failure, such as when rubbed against a rough surface. Placing higher angle plies in the outer regions enhances durability. Preferably, the outer shell 20 will have an axial stiffness of at least 5.5 Msi and a modulus in the radial plane (the radial plane containing angle ε on FIG. 7) of at least 10 Msi. Torsional strength and stiffness become more critical factors in medium and large caliber firearm barrels where the mass and diameter of the projectile become significant relative to the barrel outer diameter, imparting significant torsional force on the barrel.

In one embodiment found to satisfactorily balance the foregoing considerations, a 12K strand intermediate modulus PAN carbon fiber tow 34 is pulled through a wet epoxy thermoset resin mixture 36 at about five pounds tension, while it is being wound on type 416 stainless steel inner liner 22 rotating about its longitudinal axial bore 24. The resin mixture comprises 1.0% Thermalgraph® chopped carbon fiber pitch by weight of the resin mixture. Tow 34 is helically wound in a plurality of layered regions or "plies" extending radially outward from the liner surface, comprising an inner region 50, a plurality of intermediate regions, and an outer region 56. The tows within the inner region comprise circumferential hoops having a wrap angle of ±85° (all angles plus/minus about five degrees and measured relative to the barrel axis). At least one region has longitudinal helical wrap angles ±25°. As discussed above, interlaminar shear stress may arise between adjacent regions during operation because of heat, vibration, burst forces, and mismatched CTEs between regions, potentially leading to undesirable forces within the outer shell 20 or separation or delamination between adjacent regions. The inventors have determined that interlaminar stress is manageable if the angle wrap differential between adjacent regions is limited to less than 25°, and more preferably if the wrap angle differential is limited to approximately 20°.

In another embodiment, outer shell 20 comprises a plurality of layered regions, with an inner region 50 comprised of near-perpendicular circumferential hoops of intermediate modulus PAN precursor carbon fiber tow 34 wet-wrapped on inner liner 22 with a thermoset epoxy having a winding angle of ±85°, then a first intermediate region 52 having a winding angle of ±75°, then a second intermediate region 54 having a winding angle of ±65°, then a third intermediate region of ±45°, a fourth intermediate region of longitudinal helical wraps of ±25°, a fifth intermediate region of ±35°, and finally an outer region 56 having a wrap angle of ±45°. Any or all of these angles could be altered by plus/minus 5° and still provide comparable performance with a Type 416 stainless steel inner liner. Moreover, as mentioned previously, other types of carbon fiber, alone or in combination with PAN carbon fiber, could be used with similar results.

Figure 7:
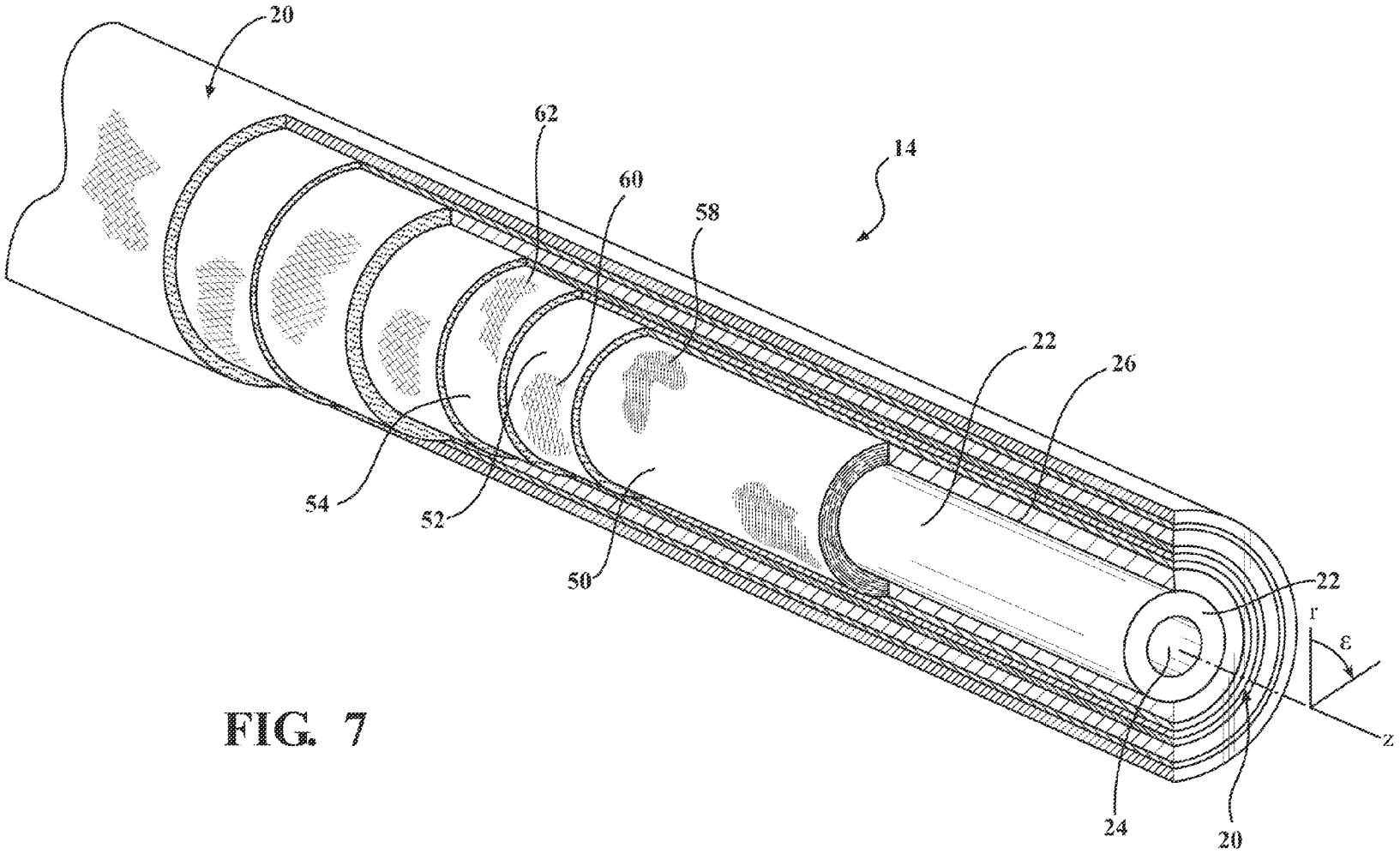
FIG. 7 is a section of the cut-away illustration showing an embodiment of a composite barrel.

FIG. 7 shows an exemplar barrel 14 produced by the winding system described, comprising a CFC outer shell 20 progressively cut away to reveal a plurality of winding regions created by winding resin infused tow 42 (or heated towpreg 43) around inner liner 22. In the embodiment illustrated, each region has a substantially different helical wrapping angle. Inner region 50 has a first wrapping angle 58, first intermediate region 52 has a second wrapping angle 60, and second intermediate region 54 has a third wrapping angle 62. Again, depending on the average effective longitudinal CTE and other mechanical properties desired, the number of regions may be any number, and the winding angles and depth of each layer may likewise vary.

The relative thickness of each region/ply affects the average effective CTE of the CFC outer shell. In the embodiment discussed immediately above, the regions described above vary significantly in radial thickness, expressed as a percentage of the radial distance from the surface of the steel inner liner 22 to the exterior surface of the finished outer shell 20. In the embodiment shown in FIG. 7, the regions have thicknesses as noted below, where the angle measurements are plus/minus 5°, and the percentage radial thickness are plus/minus 5%:

| region | wrap angle | thickness (% of CFC radius) |
|---|---|---|
| inner | ±85 | 40 (±5%) |
| 1st intermediate | ±75 | 7 (±5%) |
| 2nd intermediate | ±65 | 6 (±5%) |
| 3d intermediate | ±45 | 7 (±5%) |
| 4th intermediate | ±25 | 21 (±5%) |
| 5th intermediate | ±35 | 6 (±5%) |
| outer | ±45 | 13 (±5%) |

Following complete cure using techniques known in the art, barrel 14 is then ground down to a desired diameter on a lathe, e.g. with diamond abrasives, then polished and finished as is known to those skilled in the art. It may then be attached to a receiver and stock, to an armored vehicle, fixed or portable shell launcher, etc.

The fiber and wrapping techniques described herein can be employed with a wide variety of inner liner materials having various CTEs, including metals such as steel alloys as well as refractory materials, ceramics, and inner liners comprising a combination of the foregoing materials. The invention results in a lightweight, stiff, and strong barrel having greater burst strength than the prior art, thereby enabling thinner and lighter barrel liners. The finished barrel is durable, more resistant to laminar and interlaminar separation, and better withstands unpredictable behavior such as warping and/or separation at the CFC-steel interface due to matched CTEs.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A barrel for directing the path of a dischargeable projectile, comprising:

an inner liner defining an axial bore, the inner liner having a coefficient of thermal expansion (CTE) along the axial bore; and an outer shell surrounding and in direct contact with the inner liner, the outer shell fabricated from continuous fiber in a matrix creating a continuous fiber composite (CFC) and having an average effective CTE in the axial direction, wherein the average effective axial CTE of the outer shell approximately matches the axial CTE of the inner liner.

2. The barrel of claim 1 wherein the matrix comprises a polymer.

3. The barrel of claim 2 wherein the CFC comprises a resin mixture comprising a thermally conductive additive.

4. The barrel of claim 1 wherein the matrix comprises a metal.

5. The barrel of claim 1 wherein the matrix comprises a ceramic.

6. The barrel of claim 1 wherein the matrix comprises a mineral.

7. The barrel of claim 1 wherein the matrix comprises an allotrope of carbon.

8. The barrel of claim 1 wherein the inner liner comprises a ceramic.

9. The barrel of claim 1 wherein the inner liner comprises a metal.

10. The barrel of claim 9 wherein the inner liner comprises a steel alloy.

11. The barrel of claim 10 wherein the steel alloy is stainless steel.

12. The barrel of claim 10 wherein the steel alloy is in AISI group 400.

13. The barrel of claim 12 wherein the average effective axial CTE of the outer shell is between 4.5 and 6.5 ppm/° F.

14. The barrel of claim 10 wherein the steel alloy is in the AISI group 4000.

15. The barrel of claim 14 wherein the average effective axial CTE of the outer shell is between 5.8 and 7.8 ppm/° F.

16. The barrel of claim 1 wherein the fibers are selected from a group consisting of carbon, glass, metal, mineral, ceramic and polymer.

17. The barrel of claim 1 wherein the CFC comprises a plurality of layered regions of fibers, the fibers selected from the group consisting of unidirectional tow, towpreg, textile composite prepreg, and braided sleeve.

18. The barrel of claim 17 wherein each layered region comprises at least one unidirectional continuous fiber tow helically wound around the inner liner at a substantially constant wind angle relative to the axial bore, and wherein each layered region has a radial thickness.

19. The barrel of claim 18 wherein at least one of said layered regions comprises PAN precursor carbon fibers.

20. The barrel of claim 19 wherein the PAN precursor fibers have an intermediate modulus of elasticity.

21. The barrel of claim 18 wherein at least one of said layered regions comprises pitch precursor carbon fibers.

22. The barrel of claim 21 comprising:

an inner region having a wind angel of ±85° and a radial thickness between 35% and 45% of the CFC radial thickness;

a first intermediate region having a wind angle of ±75° and a radial thickness between 2% and 12% of the CFC radial thickness;

a second intermediate region having a wind angle of ±65° and a radial thickness between 1% and 11% of the CFC radial thickness;

a third intermediate region having a wind angle of ±45° and a radial thickness between 2% and 12% of the CFC radial thickness;

a fourth intermediate region having a wind angle of ±25° and a radial thickness between 16% and 26% of the CFC radial thickness;

a fifth intermediate region having a wind angle of ±35° and a radial thickness between 1% and 11% of the CFC radial thickness; and an outer region having a wind angle of ±45° and a radial thickness between 8% and 18% of the CFC radial thickness.

23. The barrel of claim 18 wherein the wind angle between any two adjacent regions differs by no more than approximately 20°.

24. A barrel for directing the path of a dischargeable projectile, comprising:

a metal inner liner defining an axial bore and having an axial coefficient of thermal expansion (CTE), and a continuous fiber composite (CFC) outer shell surrounding and in direct contact with the inner liner, the outer shell having an average effective axial CTE within 1 ppm/° F. of the inner liner's CTE, said CFC comprising a plurality of layered regions, at least one region comprising a PAN precursor carbon fiber tow helically wound at a substantially constant winding angle relative to the axial bore, wherein the winding angle between any two adjacent regions differs by less than 25°.

25. A firearm comprising a receiver, a stock connected to the receiver, and a barrel connected to the receiver, wherein the barrel comprises:

a metal inner liner defining an axial bore, the inner liner having an axial coefficient of thermal expansion (CTE); and an outer shell surrounding the inner liner, the outer shell fabricated from a continuous fiber composite having an average effective CTE in the axial direction that approximately matches the axial CTE of the inner liner.

26. A method of fabricating a barrel for directing the path of a dischargeable projectile, comprising the steps of:

providing an inner liner defining an axial bore and having a coefficient of thermal expansion (CTE);

fabricating a radially regionalized continuous fiber composite (CFC) outer shell around the inner liner, the outer shell having an average effective axial CTE, said fabrication comprising the steps of:

a. helically winding a fiber tow around the inner liner at a substantially constant first winding angle to form an inner region;

b. helically winding the fiber tow around said inner region at a substantially constant second winding angle to form a first intermediate region;

c. helically winding the fiber tow around the previous intermediate region at a substantially constant winding angle;

d. repeating step c as many times as desired until a final intermediate region is formed;

e. forming an outer region by helically winding the fiber tow around the final intermediate region at a substantially constant winding angle;

wherein the winding angles in adjacent regions differ by less than 25° relative to the axial bore, and wherein the inner liner's CTE is within 1 ppm/° F. of the outer shell's average effective axial CTE.

27. The method of claim 26 wherein the fiber tow comprises a PAN precursor carbon fiber.

28. The method of claim 26 wherein the fiber tow comprises towpreg.

29. The method of claim 26 wherein the fiber tow has a first composition in at least one region, and has a second and different composition in at least one other region.

* * * * *